US005957066A

United States Patent [19]

Nagato et al.

[11] Patent Number: 5,957,066

[45] **Date of Patent: *Sep. 28, 1999**

[54] FLUIDIZED-BED THERMAL REACTION APPARATUS

[75] Inventors: Shuichi Nagato; Takahiro Oshita, both of Kanagawa, Japan

[73] Assignee: Ebara Corporation, Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/750,793

[22] PCT Filed: Apr. 26, 1996

[86] PCT No.: PCT/JP96/01169

§ 371 Date: Dec. 18, 1996

§ 102(e) Date: Dec. 18, 1996

[87] PCT Pub. No.: WO96/34232

PCT Pub. Date: Oct. 31, 1996

[30] Foreign Application Priority Data

Apr. 26, 1995 [JP] Japan ..... 7-102634

[51] Int. Cl.[6] ..... F23G 5/00

[52] U.S. Cl. ..... 110/245; 110/263; 165/104.16; 122/4 D

[58] Field of Search ..... 110/245, 348, 110/263, 300; 165/104.16; 34/509, 583, 589; 122/4 D

[56] References Cited

U.S. PATENT DOCUMENTS

| | | | |
|---|---|---|---|
| 4,249,472 | 2/1981 | Mitchell . | |
| 4,419,330 | 12/1983 | Ishihara et al. . | |
| 4,535,706 | 8/1985 | Klaschka | 110/245 |
| 4,879,958 | 11/1989 | Allen et al. | 110/245 |
| 4,938,170 | 7/1990 | Ohshita et al. . | |
| 5,039,301 | 8/1991 | Allen et al. | 110/245 X |
| 5,138,982 | 8/1992 | Ohshita et al. . | |
| 5,313,913 | 5/1994 | Ohshita et al. . | |
| 5,401,130 | 3/1995 | Chiu et al. . | |
| 5,422,080 | 6/1995 | Sinn et al. | 110/245 X |
| 5,620,488 | 4/1997 | Hirayama et al. | 110/245 X |
| 5,682,827 | 11/1997 | Nagato et al. . | |

FOREIGN PATENT DOCUMENTS

| | | |
|---|---|---|
| 0 047 159 | 3/1982 | European Pat. Off. . |
| 0 369 004 | 5/1990 | European Pat. Off. . |
| 1 498 034 | 11/1965 | France . |
| 53-102138 | 1/1977 | Japan . |
| 52-118858 | 5/1977 | Japan . |
| 57-124608 | 8/1982 | Japan . |
| 63-271016 | 11/1988 | Japan . |
| 4-208304 | 7/1992 | Japan . |
| 4-214110 | 8/1992 | Japan . |
| 4-217708 | 8/1992 | Japan . |
| 4-122926 | 11/1992 | Japan . |
| WO 89/00659 | 1/1989 | WIPO . |

OTHER PUBLICATIONS

Patent Abstracts of Japan, vol. 017, No. 447 (M–1464), Apr. 20, 1993, * Abstract *.

*Primary Examiner*—Henry A. Bennett
*Assistant Examiner*—Susanne C. Tinker
*Attorney, Agent, or Firm*—Wenderoth, Lind & Ponack, L.L.P.

[57] ABSTRACT

In a fluidized-bed thermal reaction apparatus for burning or gasifying combustible matter containing incombustible components, deposition of incombustible components in a fluidized-bed furnace is prevented, and incombustible components are smoothly removed, thereby efficiently burning or gasifying combustible matter. The fluidized-bed thermal reaction apparatus has a weak diffusion plate, a strong diffusion plate, and an auxiliary diffusion plate, each having a large number of fluidizing gas feed holes, and an incombustible component outlet disposed between the auxiliary diffusion plate and the strong diffusion plate. A part of fluidizing gas is supplied from the incombustible component outlet, or the incombustible component outlet is provided to open horizontally. Thus, a continuous fluidized bed circulating stream is formed in the furnace bottom. The weak and auxiliary diffusion plates each has a downwardly inclined surface extending toward the incombustible component outlet. The strong diffusion plate has an upwardly surface which gradually rises as the distance from the incombustible component outlet increases.

22 Claims, 9 Drawing Sheets

FLUIDIZED-BED THERMAL REACTION APPARATUS

FIELD OF THE INVENTION

The present invention relates to a fluidized-bed thermal reaction apparatus usable, for example, as a fluidized-bed combustion apparatus, a fluidized-bed gasification apparatus, or a fluidized-bed carbonization system, in which solid combustible matter containing incombustible components, e.g. industrial waste, urban waste, or coal, is burned or gasified in a fluidized-bed furnace. More specifically, the present invention relates to a fluidized-bed thermal reaction apparatus capable of smoothly discharging incombustible components from a fluidized-bed furnace, avoiding deposition of incombustible components at a specific portion in the furnace, uniformly and efficiently burning or gasifying the combustible matter, and stably recovering a product such as thermal energy or combustible gas.

Prior Art

With the development of the economy, the amount of solid combustible matter containing incombustible components, e.g. industrial waste or urban waste, is steadily increasing. Such combustible substances contain a large amount of energy but vary in property, shape, etc. and have a large amount of incombustible matter of irregular form mixed therein. Therefore, it is difficult to stably burn such combustible substances for effective utilization of energy, or to gasify them to produce combustible gas.

JP-A-4-214110 (Japanese Patent Application Unexamined Publication (KOKAI) No. 4-214110) discloses a fluidized-bed combustion apparatus for waste matter in which waste matter containing incombustible matter is burned in a fluidized-bed furnace, and during combustion, the incombustible matter is smoothly discharged to the outside of the furnace, thereby enabling stabilized combustion. In a combustion apparatus shown in FIG. 1 of this publication, an incombustible matter discharge opening 50 is formed between an air diffusing plate 40 and a furnace wall, and a top surface 44 of the air diffusing plate is tilted such that the side of the top surface 44 which is closer to the incombustible matter discharge opening 50 is lower in level, and a larger amount of air is supplied to the lower side of the air diffusing plate 40 than to the higher side of the plate 40. However, at the lower side of the air diffusing plate 40, the fluidized bed is vigorously fluidized by a large amount of air supplied. Therefore, the fluidized bed shows properties close to those of liquids. Accordingly, in the fluidized bed, substances whose specific gravity is larger than the fluidized bed settle, while substances whose specific gravity is smaller than the fluidized bed float therein. That is, so-called gravity separation action occurs. Therefore, incombustible components of large specific gravity settle and, in consequence undesirably deposit on the furnace bottom before reaching the incombustible matter discharge opening 50. Moreover, because the incombustible matter discharge opening 50, which is not supplied with the fluidizing gas, opens in the planar surface of the furnace bottom, a portion of the fluidized bed which lies over the incombustible matter discharge opening 50 is not stabilized.

A thermal processing apparatus shown in FIG. 11 of the publication of JP-A-4-214110 has air diffusing plates 90*a* and 90*b* with downwardly inclined surfaces extending from the center of the furnace toward two incombustible matter discharge openings 95*a* and 95*b*, respectively, and air diffusing plates 90*c* and 90*d* with downwardly inclined surfaces extending from the surface side walls toward the incombustible matter discharge openings 95*a* and 95*b*, respectively. A larger amount of air is supplied from air diffusing plates close to the incombustible matter discharge openings than from other portions through air chambers 93*c* and 93*e*. The fluidized bed that is vigorously fluidized by a large amount of air exhibits properties close to those of liquids. Thus, so-called gravity separation occurs in the fluidized bed. That is, substances whose specific gravity is larger than the fluidized bed settle, while substances whose specific gravity is smaller than the fluidized bed float therein.

In consequence of the settling of incombustible components having a large specific gravity, the incombustible components deposit on the furnace bottom before reaching the incombustible matter discharge openings 95*a* and 95*b*. This hinders smooth discharge of incombustible matter. In addition, the fluidity gradually becomes inferior, and it eventually becomes impossible to operate the apparatus. Meanwhile, the incombustible matter discharge openings, in which no fluidizing gas is blown, open in the planar surface of the furnace bottom. Therefore, a fixed bed, which is not fluidized, is formed near and over each incombustible matter discharge opening. The fixed bed interferes with the formation of a smooth circulating stream in the fluidized bed. This hinders the dispersion and mixing of fuel in the fluidized bed and also the discharge of incombustible components.

JP-B2-5-19044 (Japanese Patent Application Post-Examination Publication No. 5-19044) discloses a fluidized-bed furnace for incinerating waste matter containing incombustible matter such as metal chips, soil and stone. The hearth of the fluidized-bed furnace in this publication has a downwardly inclined surface extending toward an incombustible matter discharge opening 5 disposed in the center of the hearth, and fluidizing air is supplied such that the amount of fluidizing air per unit area of the hearth is large in the vicinity of the incombustible matter discharge opening and stepwisely reduces toward the furnace side wall. Accordingly, a circulating stream, which flows upwardly before the incombustible matter discharge opening 5 in the center and which flows downwardly in the vicinity of the furnace side wall, occurs in the fluidized bed. Meanwhile, waste matter is supplied to a region directly above the incombustible matter discharge opening 5. Therefore, the supplied waste matter is blown up by the upward stream and burns at the top of the bed, or it is scattered to the free board and burns there. Thus, the efficiency of combustion in the fluidized bed reduces unfavorably.

In a case where waste matter is introduced from the furnace side-wall side in order to eliminate the above problems, the waste matter is favorably dispersed and mixed in the fluidized bed by the downward stream, and the efficiency of combustion in the bed is improved. However, because a large amount of air is supplied to a position before the incombustible matter discharge opening 5, the fluidized bed that is vigorously fluidized by the large amount of air exhibits properties close to those of liquids as in the case of JP-A-4-214110. At that position, substances whose specific gravity is larger than the fluidized bed settle, while substances whose specific gravity is smaller than the fluidized bed float. That is, so-called gravity separation occurs. Therefore, incombustible components of large specific gravity settle, and in consequence deposit on the furnace bottom before reaching the incombustible matter discharge opening. This hinders smooth discharge of incombustible components. Problems relating to the outfeed of incombustible components similarly arise in a fluidized-bed gasification apparatus having a similar fluidized bed.

Problems that the Invention is to Solve

A general object of the present invention is to solve the above-described problems of the conventional techniques and to provide a fluidized-bed thermal reaction apparatus wherein solid combustible matter containing incombustible components, e.g. industrial waste, urban waste, or coal, is burned in a fluidized-bed furnace, and wherein incombustible components of large specific gravity can be smoothly taken out of the fluidized-bed furnace, so that deposition of incombustible components on a specific portion in the furnace is eliminated, and fluidization in the furnace is stabilized, thereby enabling combustible matter to be uniformly burned or gasified.

When supported by a moving bed (in which a fluid medium is in a transient state between a fixed bed and a fluidized bed), incombustible components of large specific gravity, e.g. iron, cannot readily settle but can be moved horizontally. In a fluidized bed in which the fluid medium is vigorously fluidized, however, such incombustible components rapidly settle and deposit, thus becoming difficult to move and discharge. In view of this fact, an object of the present invention is, more specifically, to provide a fluidized-bed thermal reaction apparatus wherein combustible matter containing incombustible components, which has been supplied into the furnace, is moved to the vicinity of an incombustible component outlet by a moving bed, and a fluid medium is vigorously fluidized in the vicinity of the incombustible component outlet, thereby rapidly burning or gasifying combustible components and also allowing incombustible components of large specific gravity to separate from the combustible components by settling and to discharge from the incombustible component outlet.

Another object of the present invention is to provide a fluidized-bed thermal reaction apparatus wherein the flow of a fluidizing gas is prevented from being interrupted by an incombustible component outlet, and a main fluidized bed and a main circulating stream of a fluid medium, which are formed in the furnace, are stabilized, thereby enabling favorable combustion or gasification of combustible matter.

Still another object of the present invention is to provide a fluidized-bed thermal reaction apparatus wherein, while combustible matter containing incombustible components, which is supplied into the furnace, is moving in a downward stream and horizontal stream of fluid medium, an upper fluidized bed of small specific gravity and high combustible component concentration and a lower fluidized bed of large specific gravity and high incombustible component concentration are produced by pneumatic elutriation, and the upper bed of high combustible component concentration is mixed into an upward stream, passing over an incombustible component outlet, and then further circulated, while incombustible components and fluid medium in the lower fluidized bed of large specific gravity and high incombustible component concentration are preferentially taken out of the furnace from the incombustible component outlet.

A further object of the present invention is to provide a fluidized-bed thermal reaction apparatus which is capable of effectively discharging incombustible components to the outside of the furnace and of stably recovering thermal energy by a heat recovery device disposed in a sub-fluidized bed, which is formed separately from a main fluidized bed. Other objects of the present invention will be made apparent from drawings, description of embodiments, and the appended claims.

Means of Solving the Problems

The present invention provides a fluidized-bed thermal reaction apparatus in which combustible matter containing incombustible components is burned or gasified in a fluidized-bed furnace. In the apparatus according to the present invention, a weak diffusion plate and a strong diffusion plate, each having a large number of fluidizing gas feed holes, are disposed in a bottom portion of the furnace to form a main fluidized bed, and an elongate or annular incombustible component outlet is disposed between the weak and strong diffusion plates. A combustible matter feed opening for supplying combustible matter into the fluidized-bed furnace is disposed such that combustible matter can be dropped into a region over the weak diffusion plate. The weak diffusion plate is capable of supplying a fluidizing gas so as to give a relatively low fluidizing speed to a fluid medium and form a downward stream of fluid medium, and it has a downwardly inclined surface extending toward the incombustible component outlet.

The strong diffusion plate is capable of supplying a fluidizing gas so as to give a relatively high fluidizing speed to the fluid medium and form an upward stream of fluid medium. The fluid medium forms a main circulating stream which flows in the downward and upward streams alternately. A part of fluidizing gas is supplied from the incombustible component outlet through an additional diffusion plate having a large number of fluidizing gas feed holes to fluidize the fluid medium in the vicinity of the incombustible component outlet so that the fluidized medium is continuous with the main fluidized bed, thereby stabilizing the main circulating stream. The fluidized-bed thermal reaction apparatus according to the present invention has a function of burning or gasifying combustible matter by using, as a fluidizing gas, air, steam, oxygen, combustion exhaust gas, or a mixture of these gases, and adjusting the proportion of an oxidizing gas, e.g. air or oxygen, supplied with respect to combustible matter.

Combustible matter supplied from the combustible matter feed opening moves downwardly to the vicinity of the furnace bottom together with the downward stream of fluid medium, and then moves in a horizontal direction along the downwardly inclined surface of the weak diffusion plate. While horizontally moving along the downwardly inclined surface, the combustible matter is subjected to pneumatic elutriation by the upwardly supplied fluidizing gas from below, thereby producing an upper fluidized bed of small specific gravity and high combustible component concentration and a lower fluidized bed of large specific gravity and high incombustible component concentration in the vicinity of the incombustible component outlet. The upper fluidized bed of high combustible component concentration is mixed into the upward stream of fluid medium, passing over the incombustible component outlet, and then further circulated to burn. The fluid medium and incombustible components in the lower fluidized bed are preferentially taken out from the incombustible component outlet.

Preferably, an auxiliary diffusion plate having a large number of fluidizing gas feed holes is disposed between the weak diffusion plate and the incombustible component outlet. The auxiliary diffusion plate is capable of supplying a fluidizing gas so as to give a relatively high fluidizing speed to the fluid medium, and has a downwardly inclined surface with a steeper slope than the weak diffusion plate between the lower edge of the weak diffusion plate and the incombustible component outlet such that the downwardly inclined surface extends toward the incombustible component outlet. In addition, an inclined wall is disposed over the strong diffusion plate to turn over the fluidizing gas and fluid medium flowing upwardly above the strong diffusion plate toward a region over the weak diffusion plate, that is, a central portion of the furnace. A free board is disposed above the inclined wall. The strong diffusion plate has an upwardly inclined surface which gradually rises as the distance from the incombustible component outlet increases, and it is arranged such that the fluidizing speed gradually increases as the distance from the incombustible component outlet increases.

Moreover, a heat recovery chamber is formed between the inclined wall and the furnace side wall. The heat recovery chamber is communicated with the furnace central portion at the upper and lower ends of the inclined wall. A heat recovery device is disposed in the heat recovery chamber. A third diffusion plate is disposed between the strong diffusion plate and the furnace side wall such that the third diffusion plate is contiguous with the outer edge of the strong diffusion plate. The third diffusion plate is capable of supplying a fluidizing gas so as to give a relatively low fluidizing speed to the fluid medium in the heat recovery chamber, and has an upwardly inclined surface with the same slope as that of the strong diffusion plate. The planar configuration of the furnace bottom may be rectangular or circular. A rectangular furnace bottom is formed by disposing a rectangular weak diffusion plate, incombustible component outlet and strong diffusion plate in parallel, or disposing rectangular incombustible component outlets and rectangular strong diffusion plates in symmetry with respect to the ridge of a rectangular weak diffusion plate with an angle section. A circular furnace bottom is formed by a conical weak diffusion plate which is high at the center and low at the peripheral edge, an incombustible component outlet having a configuration comprising a plurality of partial annular shapes disposed in concentric relation to the weak diffusion plate, and an annular strong diffusion plate.

In another form of the present invention, a fluidized-bed thermal reaction apparatus in which combustible matter containing incombustible components is burned or gasified in a fluidized-bed furnace has in a bottom portion of the furnace a weak diffusion plate, an auxiliary diffusion plate and a strong diffusion plate, each having a large number of fluidizing gas feed holes, and an incombustible component outlet is disposed between the auxiliary diffusion plate and the strong diffusion plate. A combustible matter feed opening is disposed over the weak diffusion plate to enable combustible matter to drop into a region over the weak diffusion plate. The weak diffusion plate is capable of supplying a fluidizing gas so as to give a relatively low fluidizing speed to a fluid medium and form a downward stream of fluid medium, and has a downwardly inclined surface extending toward the incombustible component outlet.

The auxiliary diffusion plate is capable of supplying a fluidizing gas so as to give a relatively high fluidizing speed to the fluid medium, and has a downwardly inclined surface with a steeper slope than the weak diffusion plate between the lower edge of the weak diffusion plate and the incombustible component outlet such that the downwardly inclined surface extends toward the incombustible component outlet. The strong diffusion plate is capable of supplying a fluidizing gas so as to give a relatively high fluidizing speed to the fluid medium and form an upward stream of fluid medium. The lower edge of the downwardly inclined surface of the auxiliary diffusion plate overlaps the edge of the neighboring strong diffusion plate in the horizontal direction, and these edges are spaced from each other in the vertical direction. The incombustible component outlet opens in the vertical gap between the two edges. That is, the outlet opens horizontally.

Preferably, an inclined wall is disposed over the strong diffusion plate to turn over the fluidizing gas and fluid medium flowing upwardly above the strong diffusion plate toward a region over the weak diffusion plate, that is, a central portion of the furnace. A free board is disposed above the inclined wall. The strong diffusion plate has an upwardly inclined surface which gradually rises as the distance from the incombustible component outlet increases, and it is arranged such that the fluidizing speed gradually increases as the distance from the incombustible component outlet increases. A heat recovery chamber is formed between the inclined wall and the furnace side wall. The heat recovery chamber is communicated with the furnace central portion at the upper and lower ends of the inclined wall. A heat recovery device is disposed in the heat recovery chamber. A third diffusion plate is disposed between the strong diffusion plate and the furnace side wall such that the third diffusion plate is contiguous with the outer edge of the strong diffusion plate. The third diffusion plate is capable of supplying a fluidizing gas so as to give a relatively low fluidizing speed to the fluid medium in the heat recovery chamber, and has an upwardly inclined surface with approximately the same slope as that of the strong diffusion plate.

The planar configuration of the furnace bottom may be rectangular or circular. A rectangular furnace bottom is formed by disposing a rectangular weak diffusion plate and strong diffusion plate in parallel, or disposing rectangular weak diffusion plates and rectangular strong diffusion plates in symmetry with respect to the ridge of a rectangular weak diffusion plate with an angle section. A circular furnace bottom is formed by a conical weak diffusion plate, an inverted cone-shaped strong diffusion plate disposed in concentric relation to the weak diffusion plate, and an incombustible component outlet provided to open in a vertical gap between the outer peripheral edge of the weak diffusion plate and the inner peripheral edge of the strong diffusion plate.

OPERATION OF THE INVENTION

In the fluidized-bed thermal reaction apparatus according to the present invention, a fluidizing gas supplied through the weak diffusion plate gives a relatively low fluidizing speed to the fluid medium to form a downward stream of fluid medium, and a fluidizing gas supplied through the strong diffusion plate gives a relatively high fluidizing speed to the fluid medium to form an upward stream of fluid medium. Thus, a main fluidized bed including the downward and upstream streams is formed. After moving downwardly in the form of the downward stream, the fluid medium is guided by the downwardly inclined surface of the weak diffusion plate and becomes an upward stream to rise in the vicinity of the strong diffusion plate. The fluid medium having reached the top of the fluidized bed is drawn toward the furnace central portion and then becomes a downward stream again, thus forming a main circulating stream which circulates in the main fluidized bed.

By supplying a fluidizing gas through the additional diffusion plate, which is disposed in the incombustible component outlet, so as to give a relatively high fluidizing speed, the fluid medium near and over the opening of the incombustible component outlet is vigorously fluidized. Consequently, the fluid medium over the incombustible component outlet also becomes a fluidized bed, not a fixed bed. Thus, the fluidization zone continues from the weak diffusion plate to the strong diffusion plate, and a main circulating stream, which flows downwardly in the weak fluidization zone and flows upwardly in the strong fluidization zone, is stably formed without a break. The inclined wall over the strong diffusion plate turns over the fluidizing gas and fluid medium flowing upward above the strong diffusion plate toward the central portion of the furnace to promote the formation of the main circulating stream.

Combustible matter is dropped into a region over the weak diffusion plate from the combustible matter feed opening. The region over the weak diffusion plate has been gently fluidized and is in the state of a moving bed, which is an intermediate state between a fixed bed and a fluidized bed. In the moving bed, combustible matter and incombustible components are suspended in the fluid medium. Therefore, the combustible matter and incombustible components flow downward together with the circulating stream in the fluidized bed, and then move horizontally to the fluidization zone over the strong diffusion plate where the fluidizing speed is high. However, the combustible matter and incombustible components are in a gently fluidized state, although they are suspended in the fluid medium. Therefore, while the combustible matter and incombustible components are moving horizontally, so-called gravity separation occurs slowly. That is, substances whose specific gravity is larger than the moving bed gradually settle, while substances whose specific gravity is smaller than the moving bed float. As a result, combustible matter of small specific gravity moves upwardly, while incombustible components of large specific gravity move downwardly, and thus an upper fluidized bed of high combustible component concentration and a lower fluidized bed of high incombustible component concentration are formed.

The upper fluidized bed of small specific gravity and high combustible component concentration is mixed into the upward stream of fluid medium, passing over the incombustible component outlet, and in the case of a combustion apparatus, the upper fluidized bed is satisfactorily burned in the upward stream of oxidizing atmosphere having a high fluidizing speed. Since the upper fluidized bed has a relatively small content of incombustible matter, it is favorably burned in the upward stream. In the case of a gasification apparatus, combustible matter is partially burned and thermally decomposed efficiently in the upper fluidized bed. Thus, excellent gasification is effected.

The lower fluidized bed of large specific gravity and high incombustible component concentration is guided to the downwardly inclined surface of the weak diffusion plate to enter the incombustible component outlet, which is disposed between the weak diffusion plate and the strong diffusion plate. Thus, the fluid medium and incombustible components are taken out from the incombustible component outlet. That is, since the fluid medium over the weak diffusion plate is in the state of a moving bed, even incombustible components of extremely large specific gravity, e.g. iron, are supported by the moving bed and moved to the vicinity of the incombustible component outlet. Accordingly, no incombustible components will deposit on the furnace bottom. Meanwhile, a fluidizing gas is supplied through the diffusion plate provided in the incombustible component outlet so as to give a relatively high fluidizing speed, thereby vigorously fluidizing the fluid medium near and over the entrance of the incombustible component outlet.

Consequently, the fluid medium near and over the entrance of the incombustible component outlet is in the state of being vigorously fluidized, not in the state of a fixed bed nor a moving bed. Therefore, the fluidized bed shows properties close to those of liquids. Accordingly, so-called gravity separation occurs easily in the fluidized bed. That is, substances whose specific gravity is larger than the fluidized bed settle, while substances whose specific gravity is smaller than the fluidized bed float in the fluidized bed. Accordingly, incombustible components of large specific gravity rapidly settle toward the incombustible component outlet; therefore, the discharge of incombustible components is extremely easy and smooth. Since incombustible components in the furnace are smoothly and efficiently taken out, they do not interfere with combustion or gasification in the furnace. Since combustible components and incombustible components are separated by pneumatic elutriation and almost only incombustible components are taken out, the loss of heat from the furnace is small, and the treatment of incombustible components taken out is also relatively easy.

Preferably, an auxiliary diffusion plate with a steeper slope or incline than the weak diffusion plate is used to supply a fluidizing gas of relatively high fluidizing speed, thereby changing the moving bed moved from above the weak diffusion plate into a fluidized bed. Thus, separation of incombustible components by pneumatic elutriation progresses rapidly, and in particular, incombustible components of large specific gravity, e.g. iron, settle onto the auxiliary diffusion plate. However, since the auxiliary diffusion plate has a steep slope, such incombustible components of large specific gravity are smoothly guided to the incombustible component outlet. The strong diffusion plate is arranged such that the fluidizing speed gradually increases as the distance from the incombustible component outlet increases. Thus, the strong diffusion plate promotes the formation of a main circulating stream centered at the furnace central portion.

The third diffusion plate gives a relatively low fluidizing speed to the fluid medium in the heat recovery chamber to form a moving bed which moves downwardly in the heat recovery chamber. A part of the fluid medium in the upper part of the upward stream, which is turned over toward the furnace central portion by the inclined wall, enters the heat recovery chamber over the upper end of the inclined wall and flows downwardly in the form of a moving bed. After being cooled by heat exchange with the heat recovery device, the fluid medium is guided along the third diffusion plate to a region over the strong diffusion plate and then mixed into the upward stream and heated by heat of combustion in the upward stream. Thus, a sub-circulating stream of fluid medium is formed by the downward stream in the heat recovery chamber and the upward stream in the main combustion chamber, and heat of combustion in the fluidized-bed furnace is recovered by the heat recovery device in the heat recovery chamber. The total heat transfer coefficient of the heat recovery device changes greatly with the fluidizing speed. Therefore, the amount of heat recovered can be readily controlled by changing the rate of fluidizing gas passing through the third diffusion plate.

By forming the planar configuration of the fluidized-bed furnace into a rectangular shape, the design and production of the furnace can be made relatively easy. However, if the configuration of the furnace viewed in plan is circular, it is possible to increase the pressure resistance of the side wall of the fluidized-bed furnace, and it becomes easy to prevent leakage of odor and harmful gas generated from combustion of waste matter by reducing the pressure in the furnace, or to obtain a high-pressure gas capable of driving a gas turbine by increasing the pressure in the furnace conversely.

In another form of the present invention, regarding diffusion plates around the incombustible component outlet, the lower edge of one diffusion plate substantially aligns with the lower edge of another diffusion plate when viewed in a plan, and these edges are spaced from each other in the vertical direction. The incombustible component outlet opens in the vertical gap between the two edges. Thus, a region over the incombustible component outlet can be fluidized without providing a diffusion plate on the inner surface of the incombustible component outlet. As a result, the fluidization zone continues from the weak diffusion plate to the strong diffusion plate, and a circulating stream, which flows downwardly in the weak fluidization zone and flows upwardly in the strong fluidization zone, is stably formed without a break.

EMBODIMENTS OF THE INVENTION

Figure 10:
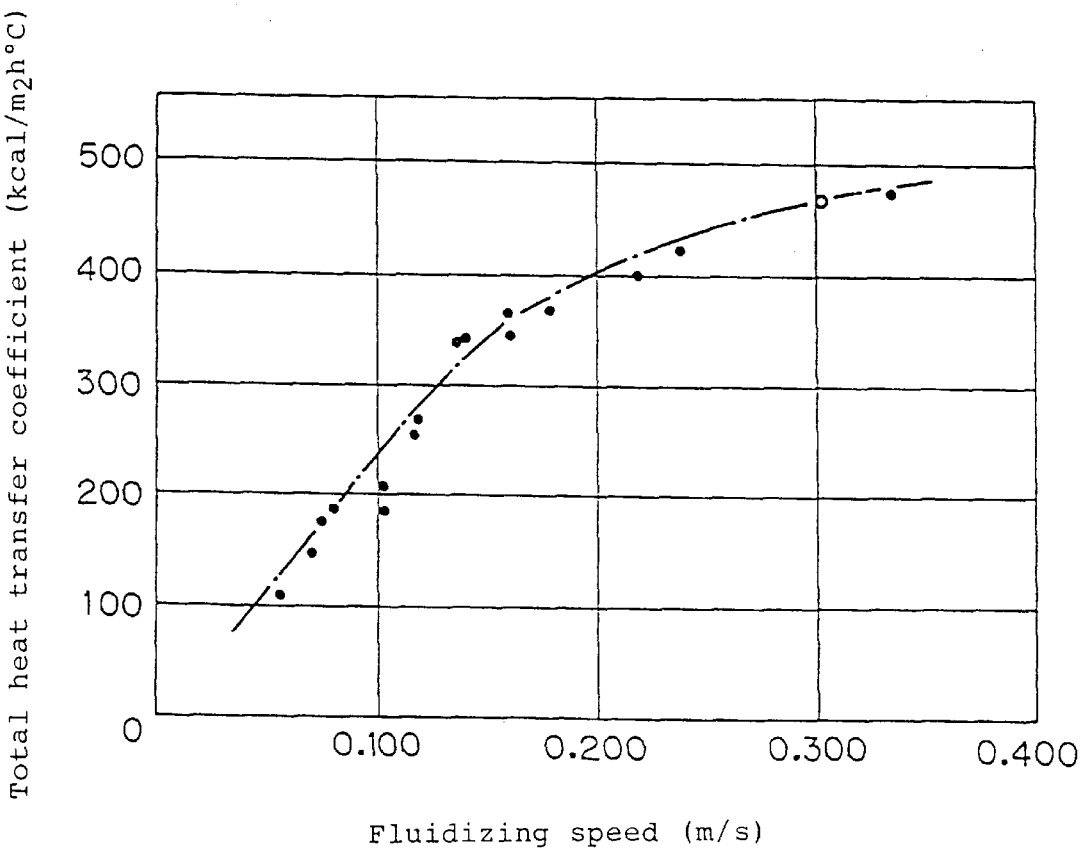
FIG. 10 is a graph showing the relationship between the total heat transfer coefficient of a heat recovery device and the fluidizing speed of a fluidizing gas supplied through a third diffusion plate in a fluidized-bed thermal reaction apparatus according to the present invention.
Figure 11:
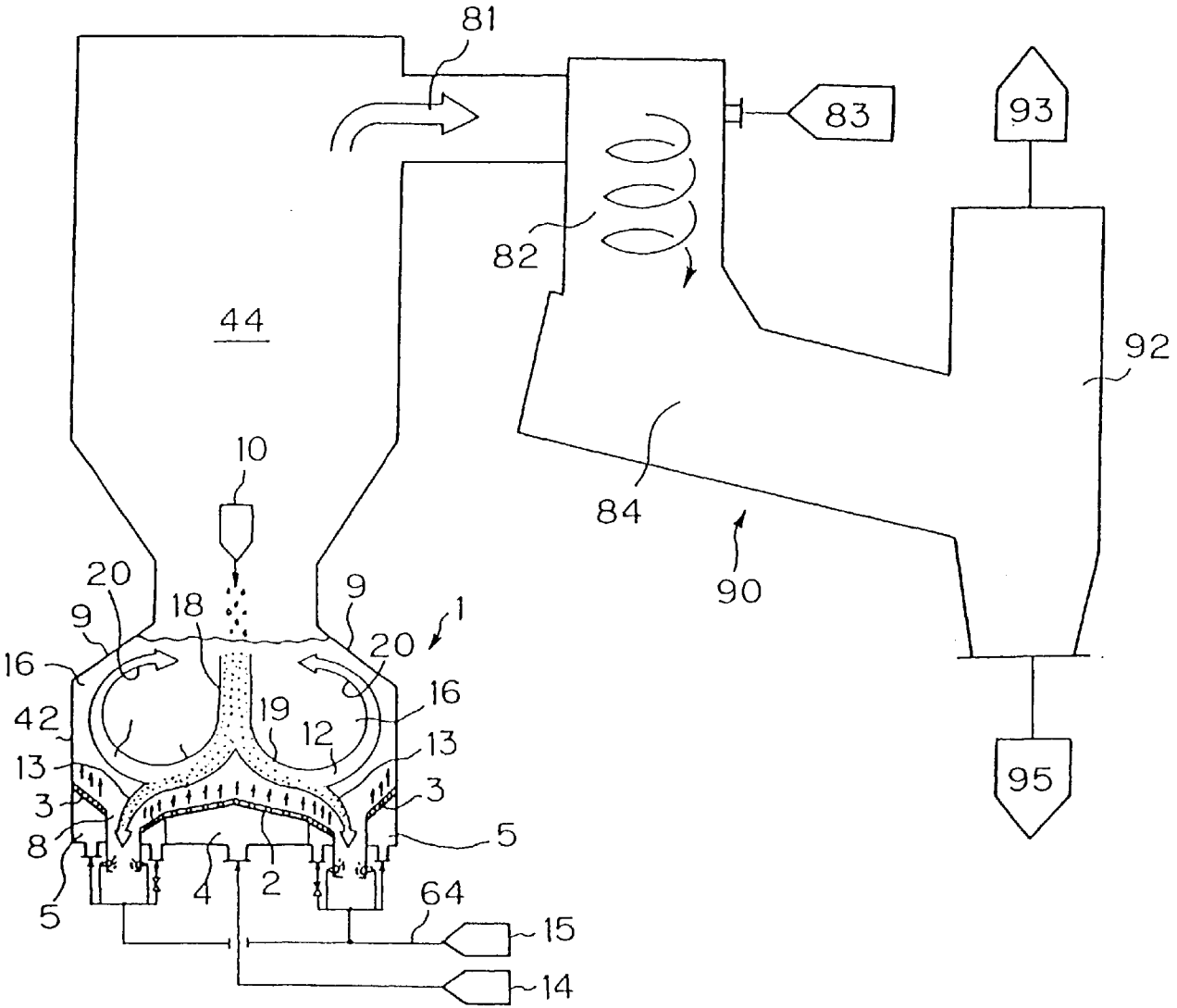
FIG. 11 is a sectional view schematically showing a furnace bottom portion of a fluidized-bed thermal reaction apparatus according to an eighth embodiment of the present invention.

A plurality of embodiments of the present invention will be described below with reference to the drawings. However, the technical scope of the present invention is not limited to these embodiments, but is defined by the claims. FIGS. 1 to 10 show fluidized-bed thermal reaction apparatuses according to embodiments of the present invention in which the present invention is arranged in the form of a combustion apparatus, and FIG. 11 shows a fluidized-bed thermal reaction apparatus according to an embodiment of the present invention in which the present invention is arranged in the form of a gasification furnace. In the figures, the same or corresponding members are denoted by the same reference characters, and redundant description is omitted.

Figure 1:
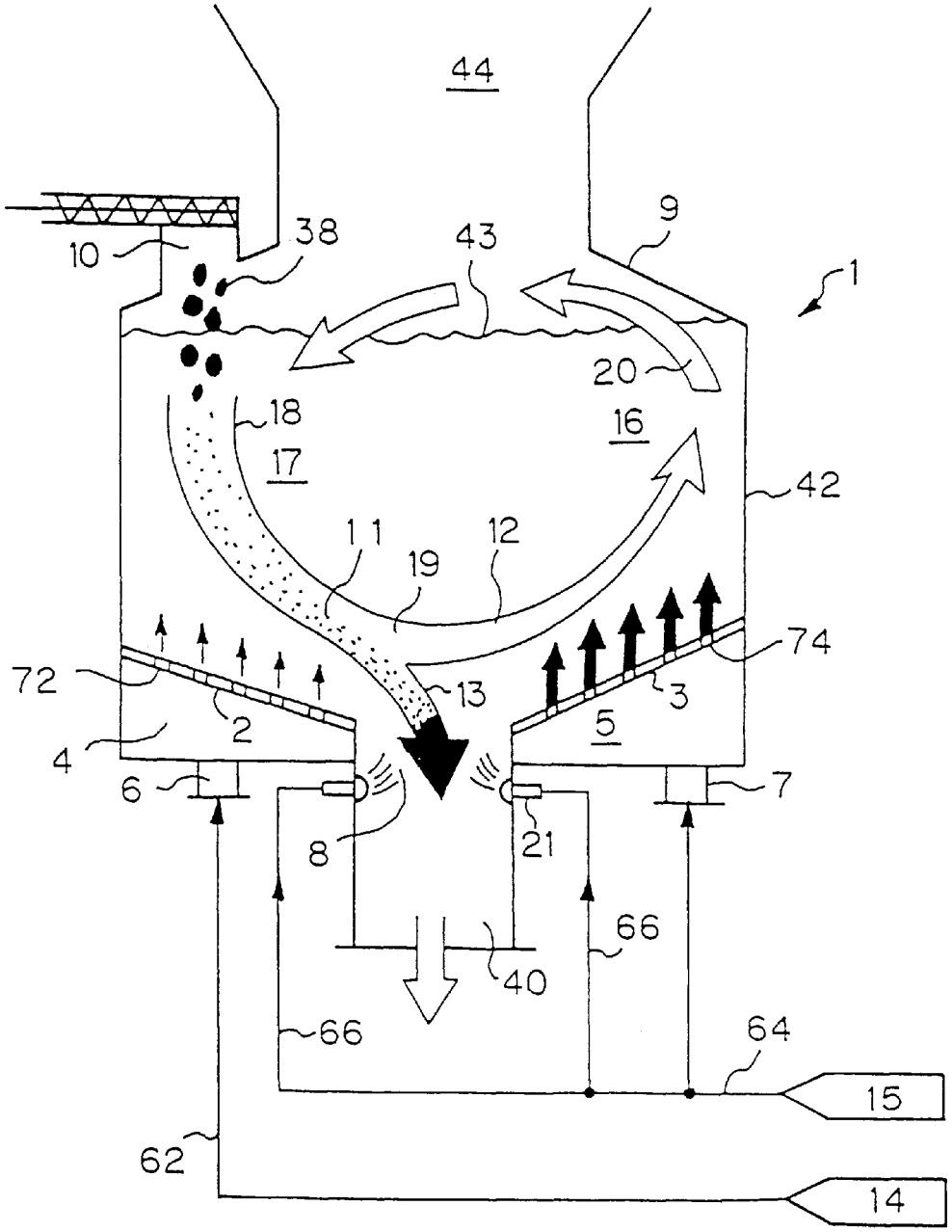
FIG. 1 is a vertical sectional view schematically showing an essential part of a fluidized-bed thermal reaction apparatus according to a first embodiment of the present invention.

FIG. 1 is a vertical sectional view schematically showing an essential part of a first embodiment of the present invention. In FIG. 1, a fluidized-bed thermal reaction apparatus has an incombustible component outlet 8 disposed in the center of a furnace bottom portion of a fluidized-bed furnace 1; a weak diffusion plate 2 and a strong diffusion plate 3, which are each disposed between the incombustible component outlet 8 and a side wall 42; a combustible matter feed opening 10 disposed over the weak diffusion plate 2; an inclined wall 9 disposed over the strong diffusion plate 3; and a free board 44 provided above the inclined wall 9. The planar configuration of the furnace may be rectangular or circular. In the furnace 1, a fluid medium comprising incombustible particles, e.g. sand, is blown up by a fluidizing gas, e.g. air, blown upwardly into the furnace through the weak diffusion plate 2 and the strong diffusion plate 3. Consequently, the fluid medium is brought into a floating state, and thus a main fluidized bed is formed. A variable top surface 43 of the main fluidized bed lies at the height of an intermediate portion of the inclined wall 9. To effect combustion, the oxygen content of the fluidizing gas is increased. However, by reducing the oxygen content of the fluidizing gas, it is possible to gasify combustible matter.

A weak diffusion chamber 4, which is disposed underneath the weak diffusion plate 2, is supplied with a fluidizing gas from a gas supply source 14 through a piping 62 and a connector 6. The fluidizing gas is supplied into the furnace at a relatively low fluidizing speed through a large number of fluidizing gas feed holes 72 provided in the weak diffusion plate 2 to form a weak fluidization zone 17 of fluid medium over the weak diffusion plate 2. In the weak fluidization zone 17, a downward stream 18 of fluid medium is formed. The top surface of the weak diffusion plate 2 is a downwardly inclined surface which becomes lower toward the incombustible component outlet 8 as viewed in vertical section. In FIG. 1, the downward stream 18 becomes, in the vicinity of the top surface of the weak diffusion plate 2, an approximately horizontal stream 19 flowing along the downwardly inclined surface.

The strong diffusion plate 3 has a large number of fluidizing gas feed holes 74, and further has a strong diffusion chamber 5 underneath it. The strong diffusion chamber 5 is supplied with a fluidizing gas from a gas supply source 15 through a piping 64 and a connector 7. The fluidizing gas is supplied into the furnace at a relatively high fluidizing speed through the large number of fluidizing gas feed holes 74 to form a strong fluidization zone 16 of fluid medium over the strong diffusion plate 3. In the strong fluidization zone 16, an upward stream 20 of fluid medium is formed. The top surface of the strong diffusion plate 3 is an upwardly inclined surface formed such that it is lowest in the vicinity of the incombustible component outlet 8 and becomes higher toward the side wall 42 as viewed in vertical section.

In FIG. 1, the fluid medium in the fluidized-bed furnace 1 moves from the top of the upward stream 20 to the top of the weak fluidization zone 17, that is, the top of the downward stream 18, and then moves downwardly in the downward stream 18. Then, in the horizontal stream 19 the fluid medium moves to the bottom of the upward stream 20, thus producing a main circulating stream. The inclined wall 9 is inclined such that it becomes higher toward the furnace central portion from the furnace side wall 42, to forcedly turn over the upward stream toward a region over the weak diffusion plate 2.

The combustible matter feed opening 10 for supplying combustible matter 38 into the fluidized-bed furnace 1 is disposed over the weak diffusion plate 2 to drop combustible matter into a region over the weak diffusion plate 2. The combustible matter 38 supplied from the combustible matter feed opening 10 become mixed in the downward stream 18 of fluid medium and moves downwardly to the vicinity of the furnace bottom together with the downward stream 18 while being thermally decomposed or partially burned. Next, the combustible matter 38 is mixed in the horizontal stream 19 of fluid medium flowing along the downwardly inclined surface of the weak diffusion plate 2 and then moves horizontally toward the incombustible component outlet 8. The combustible matter in the horizontal stream 19 is subjected to pneumatic elutriation and gravity separation by the fluidizing gas supplied upwardly. As a result, incombustible components 11 of large specific gravity move to the lower side of the horizontal stream, while combustible components of small specific gravity gather in the upper part of the horizontal stream. Consequently, an upper fluidized bed 12 of small specific gravity and high combustible component concentration and a lower fluidized bed 13 of large specific gravity and high incombustible component concentration are formed in the vicinity of the incombustible component outlet 8.

The upper fluidized bed 12 of high combustible component concentration is mixed into the upward stream 20 of fluid medium, passing over the incombustible component outlet 8, and is burned by the oxidizing atmosphere and strong fluidization. Combustion gas generated in the fluidized bed rises to the free board 44 over the top surface 43 of the fluidized bed, and is subjected to secondary combustion, if necessary. Further, dust removal and thermal energy recovery are carried out, and then the combustion gas is discharged into the atmospheric air. The fluid medium and incombustible components in the lower fluidized bed 13 are passed through the incombustible component outlet 8. A passage 40, which is communicated with the incombustible component outlet 8, enables the incombustible matter and fluid medium dropping into the incombustible component outlet 8 to be discharged to the outside of the furnace through a hopper, a discharge damper, etc. (not shown). The fluid medium taken out of the furnace together with the incombustible components is recovered by a means (not shown) and returned to the fluidized-bed furnace 1.

In the fluidized-bed thermal reaction apparatus shown in FIG. 1, a fluidizing gas is supplied from the gas supply source 15 into the passage 40 through the piping 64, a branch pipe 66 and a nozzle 21. The fluidizing gas is blown upwardly into the furnace from the passage 40 through the incombustible component outlet 8 to fluidize the fluid medium over the incombustible component outlet 8 to form a main fluidized bed extending continuously from a region over the weak diffusion plate 2 to a region over the strong diffusion plate 3, thereby stabilizing the main circulating stream of fluid medium.

The strong diffusion plate 3 has an upwardly inclined surface which gradually rises as the distance from the incombustible component outlet 8 increases, so that the upper fluidized bed 12 separating from the horizontal stream 19, which moves approximately horizontally along the downwardly inclined surface of the weak diffusion plate 2 to a region over the incombustible component outlet 8, is gradually changed into the upward stream 20, thereby stabilizing the main circulating stream and preventing deposition of incombustible components on the strong diffusion plate 3. The arrangement may also be such that the fluidizing speed of the fluidizing gas supplied through the strong diffusion plate 3 gradually increases as the distance from the incombustible component outlet increases. This is effective in forming the main circulating stream.

Figure 2:
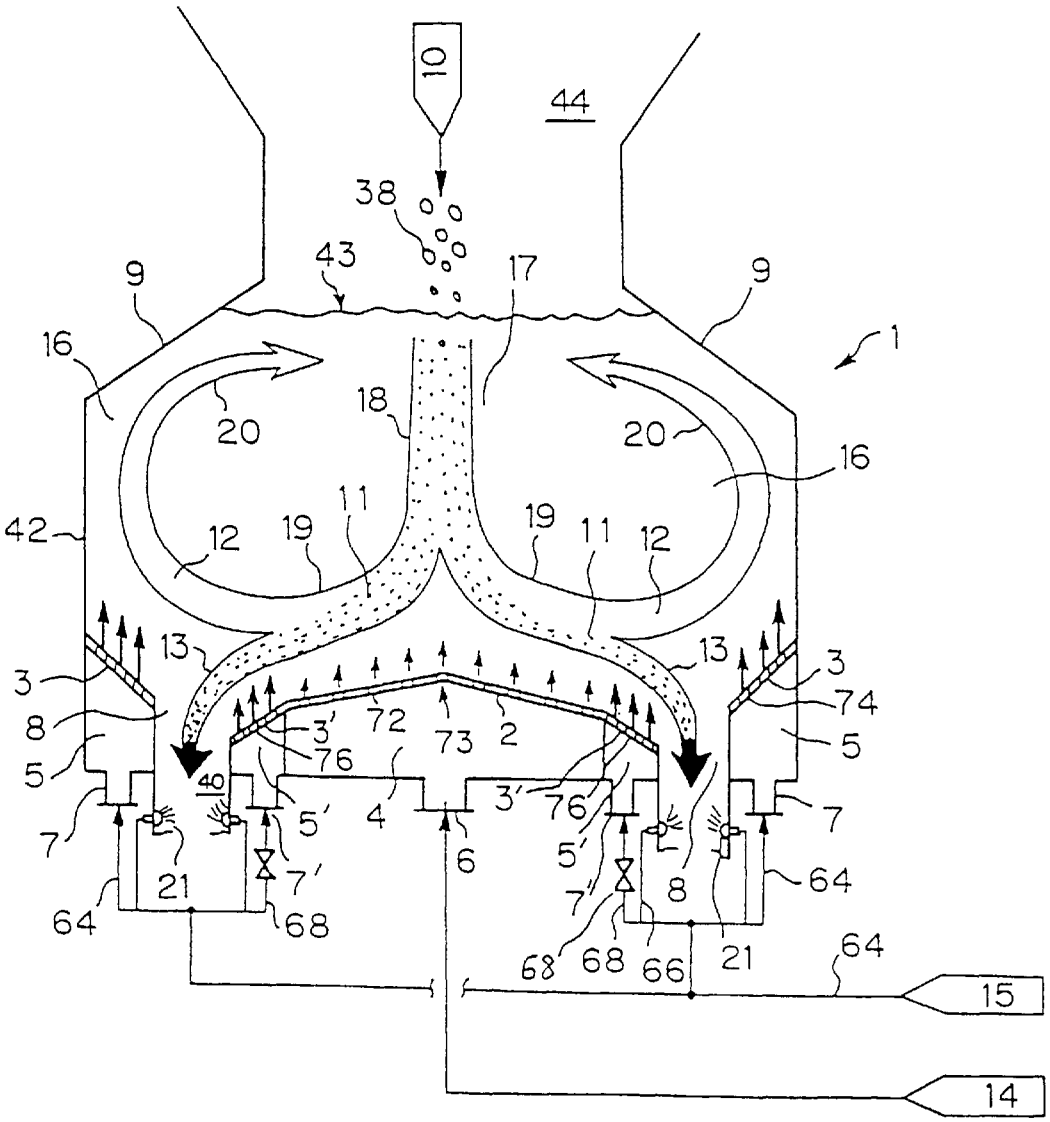
FIG. 2 is a vertical sectional view schematically showing an essential part of a fluidized-bed thermal reaction apparatus according to a second embodiment of the present invention.

FIG. 2 is a vertical sectional view schematically showing an essential part of a fluidized-bed thermal reaction apparatus according to a second embodiment of the present invention. In FIG. 2, the fluidized-bed thermal reaction apparatus has a weak diffusion plate 2 disposed in the center of a bottom portion in a fluidized-bed furnace 1; auxiliary diffusion plates 3' disposed on both sides, respectively, of the weak diffusion plate 2 and each having a large number of fluidizing gas feed holes 76; incombustible component outlets 8 and strong diffusion plates 3 disposed between the auxiliary diffusion plates 3' and a side wall 42; a combustible matter feed opening 10 disposed over the weak diffusion plate 2; inclined walls 9 disposed over the strong diffusion plates 3, respectively; and a free board 44 provided above the inclined walls 9.

The top surface of the weak diffusion plate 2 is a downwardly inclined surface that it is highest at the center and becomes lower toward each incombustible component outlet 8. In a case where the horizontal section of the furnace is circular, the top surface of the weak diffusion plate 2 is a surface of circular cone. In FIG. 2, a downward stream 18 is divided in the vicinity of the top 73 of the weak diffusion plate 2 into two approximately horizontal streams 19 flowing along the left and right downwardly inclined surfaces. In a case where the horizontal section of the furnace is circular, the top surface of the strong diffusion plate 3 is a surface of an inverted cone in which the outer peripheral edge is higher than the inner peripheral edge.

In FIG. 2, the edge portions of the weak diffusion plate 2 are connected to the auxiliary diffusion plates 3' each having a large number of fluidizing gas feed holes 76. An auxiliary diffusion chamber 5' is disposed underneath each auxiliary diffusion plate 3'. The auxiliary diffusion chamber 5' is supplied with a fluidizing gas from a gas supply source 15 through a piping 64, a branch pipe 68, a valve 68', and a connector 7'. The fluidizing gas is supplied into the furnace at a relatively high fluidizing speed from the auxiliary diffusion chamber 5' through the fluidizing gas feed holes 76 to fluidize the fluid medium over the auxiliary diffusion plate 3'.

In FIG. 2, the fluid medium in the fluidized-bed furnace 1 moves from the top of each upward stream 20 to the top of the weak fluidization zone 17, that is, the top of the downwardly stream 18, and then moves downward in the downward stream 18. Then, in each of the horizontal streams 19, the fluid medium moves to the bottom of each upward stream 20, thereby producing a main circulating stream. The downward stream 18, which comprises a moving bed, is divided in the vicinity of the top 73 of the weak diffusion plate 2 into two horizontal streams 19 flowing along the left and right downwardly inclined surfaces. In a case where the furnace plane is rectangular, two, i.e. left and right, main circulating streams are produced.

The horizontal stream over the weak diffusion plate 2 is a moving bed, in which the degree of fluidization of the fluid medium is low. Therefore, incombustible components of extremely large specific gravity, e.g. iron, in the horizontal stream are also moved without depositing on the furnace bottom. When the horizontal stream reaches a position over each auxiliary diffusion plate 3', the moving bed is changed to a fluidized bed, in which the fluidizing speed is high, by the fluidizing gas supplied through the auxiliary diffusion plate 3'. Consequently, incombustible components of large specific gravity rapidly settle by pneumatic elutriation. Since the downwardly inclined angle of the auxiliary diffusion plate 3' is steeper than that of the weak diffusion plate 2, the settling incombustible components of large specific gravity are moved to the incombustible component outlet along the downwardly inclined surface of the auxiliary diffusion plate 3' by gravity. The apparatus shown in FIG. 2 is approximately identical with the apparatus shown in FIG. 1 except that the auxiliary diffusion plates 3' and the auxiliary diffusion chambers 5' are provided, and that the weak diffusion plate 2, the incombustible component outlets, and the strong diffusion plates are formed in symmetry with respect to the furnace center. Therefore, a redundant description is omitted.

Figure 3:
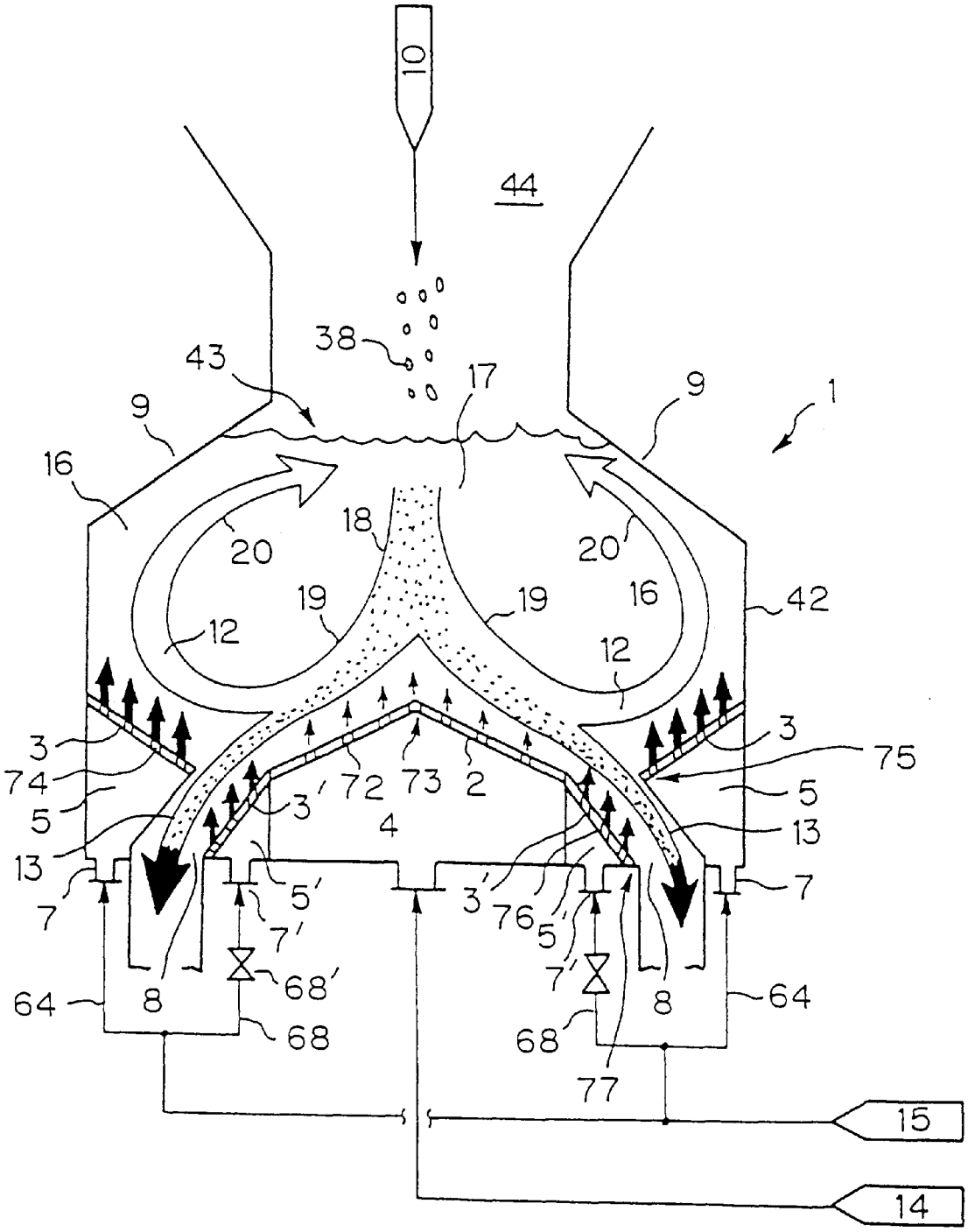
FIG. 3 is a vertical sectional view schematically showing an essential part of a fluidized-bed thermal reaction apparatus according to a third embodiment of the present invention.

FIG. 3 is a vertical sectional view schematically showing an essential part of a fluidized-bed thermal reaction apparatus according to a third embodiment of the present invention. In FIG. 3, the angle of inclination of each auxiliary diffusion plate 3' is steeper than that in FIG. 2, and the lower edge 77 of the auxiliary diffusion plate 3' extends outwardly to a position vertically aligned with the lower edge 75 of the neighboring strong diffusion plate 3, as viewed in a plan, and is spaced from the edge 75 of the neighboring strong diffusion plate 3 in the vertical direction. An incombustible component outlet 8 is provided to open in the vertical gap between the two edges, that is, to open horizontally. Although no fluidizing gas is supplied from the incombustible component outlet 8, the outlet 8 will not disrupt the main circulating stream of fluid medium because the incombustible component outlet 8 has no opening area as viewed in plan and hence will not interfere with the upward stream of fluidizing gas. The structure of the rest of the apparatus shown in FIG. 3 is approximately the same as that of the apparatus shown in FIG. 1 or 2; therefore, a description thereof is omitted.

Figure 4:
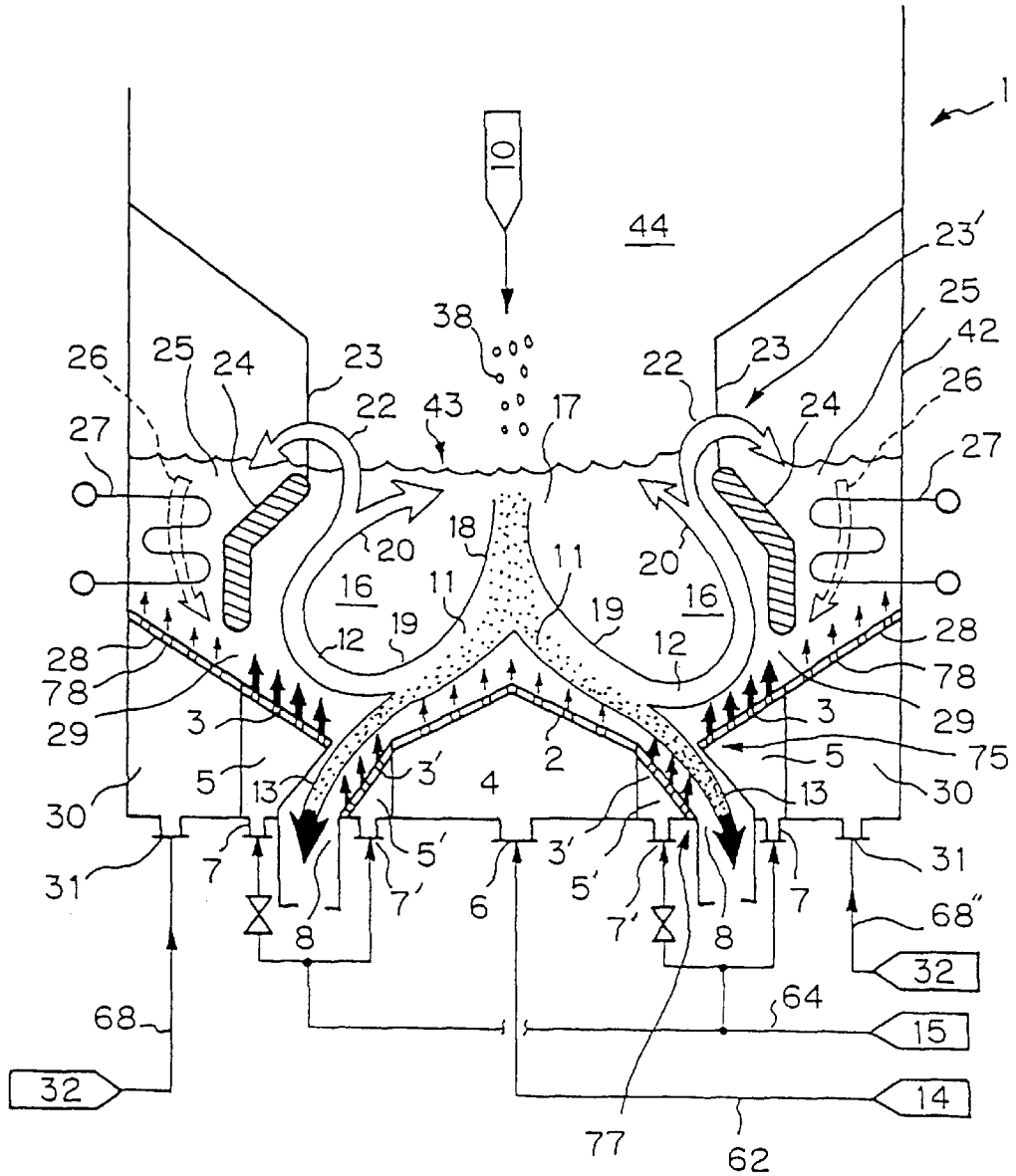
FIG. 4 is a vertical sectional view schematically showing an essential part of a fluidized-bed thermal reaction apparatus according to a fourth embodiment of the present invention.

FIG. 4 is a vertical sectional view of an essential part of a fluidized-bed thermal reaction apparatus according to a fourth embodiment of the present invention, in which each incombustible component outlet 8 is provided to open horizontally as in the case of the apparatus shown in FIG. 3, and no fluidizing gas is supplied from the incombustible component outlet 8. The apparatus shown in FIG. 4 has heat recovery chambers 25 each disposed in the vicinity of a furnace central portion which constitutes a main combustion chamber, that is, between an inclined wall 24 over a strong diffusion plate 3 and a furnace side wall 42, and a heat recovery device 27 is disposed in each heat recovery chamber 25. Each inclined wall 24 has a vertically extending lower extension. Third diffusion plates 28, which have approximately the same slope as that of the strong diffusion plates 3, each extends from the outer edge of the associated strong diffusion plate 3 to the side wall 42 over a vertical projection of the inclined wall 24.

A vertical gap between the edge of the lower extension of the inclined wall 24 and the third diffusion plate 28 defines a lower communicating passage 29 between the furnace central portion and the lower part of the heat recovery chamber 25. In addition, a plurality of vertical screen pipes 23 are disposed between the upper end of the inclined wall 24 and the furnace side wall. The space between the screen pipes 23 defines an upper communicating passage 23' for providing communication between the upper part of the heat recovery chamber 25 and the furnace central portion. A gas supply source 32 and a third diffusion chamber 30 underneath each third diffusion plate 28 are communicated with each other through a piping 68" and a connector 31. A fluidizing gas is supplied into each heat recovery chamber 25 at a relatively low fluidizing speed from the associated third diffusion chamber 30 through a large number of fluidizing gas feed holes 78 to form a downward sub-circulating stream 26 of fluid medium.

A part of the fluid medium in an upward stream 20 directed toward the furnace central portion by each inclined wall 24 forms a reverse stream 22 which passes through the upper communicating passage 23' above the inclined wall 24, and enters the upper part of the heat recovery chamber 25 where the fluid medium moves downwardly in the form of a downward stream. Then, the downward stream of fluid medium passes through the lower communicating passage 29 and is mixed in the upward stream 20 of the main circulating stream to rise and reach the top of the upward stream 20. Thus, a sub-circulating stream 26 of fluid medium passing through the heat recovery chamber is formed. The fluid medium in the sub-circulating stream 26 is cooled by heat-exchange with the heat recovery device 27 in the heat recovery chamber 25 and heated by heat of combustion in the upward stream 20. As shown in FIG. 10, the total heat transfer coefficient of the heat recovery device greatly changes depending on the fluidizing speed. Therefore, the amount of heat recovered can be effectively controlled by changing the rate of fluidizing gas passing through the third diffusion plate 28.

In the apparatuses shown in FIGS. 1 and 2, the fluidizing gas is supplied from the incombustible component outlet 8, and the main fluidized bed does not include discontinuous portion. Thus, a stable main circulating stream is formed. In the apparatuses shown in FIGS. 3 and 4, the edge of each auxiliary diffusion plate 3' lies vertically spaced from the edge of the neighboring strong diffusion plate, and an incombustible component outlet 8 is provided to open in the vertical gap between the two edges. Therefore, as viewed in plan, there is no discontinuous portion in the flow of fluidizing gas supplied upwardly from the furnace bottom. Thus, a stable main fluidized bed is formed as in the case of the apparatuses shown in FIGS. 1 and 2.

Figure 5:
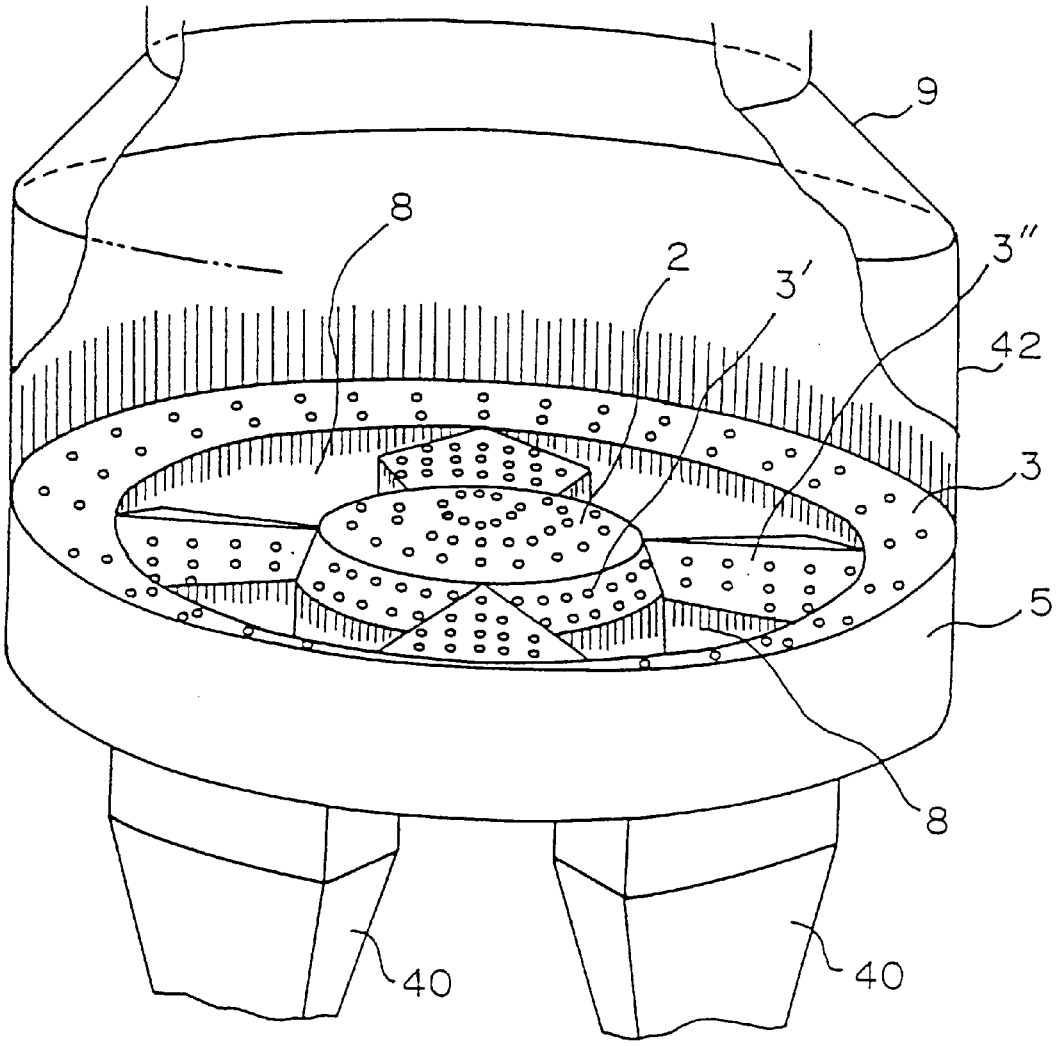
FIG. 5 is a perspective view schematically showing a furnace bottom portion of a fluidized-bed thermal reaction apparatus according to a fifth embodiment of the present invention.
Figure 6:
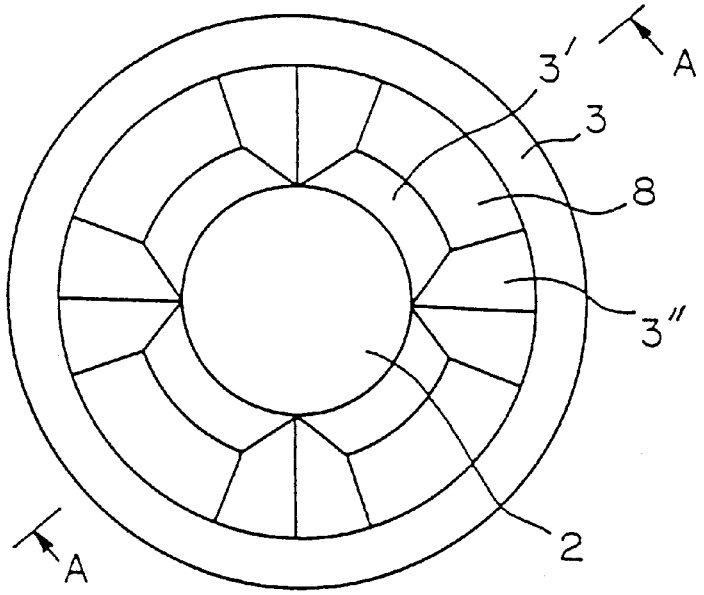
FIG. 6 is a plan view schematically showing the furnace bottom portion of the fluidized-bed thermal reaction apparatus in FIG. 5.
Figure 7:
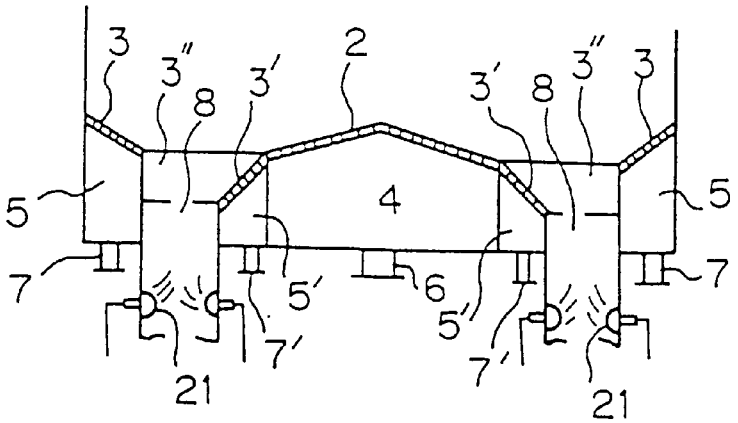
FIG. 7 is a vertical sectional view schematically showing the furnace bottom portion of the fluidized-bed thermal reaction apparatus in FIG. 5.

FIGS. 5, 6 and 7 are a perspective, plan and sectional views, respectively, showing a circular furnace bottom portion of a fluidized-bed thermal reaction apparatus according to a fifth embodiment of the present invention, which is equivalent to a case where in the embodiment shown in FIG. 2 the planar configuration of the furnace is circular. FIG. 7 is a sectional view taken along the line A—A in FIG. 6. That is, a weak diffusion plate 2 has a conical top surface which is high at the center and low at the periphery. An annular auxiliary diffusion plate 3', four partial annular incombustible component outlets 8, and a strong diffusion plate 3 are disposed in concentric relation to the weak diffusion plate 2. The inclined surface of the auxiliary diffusion plate 3' is steeper than the inclined surface of the weak diffusion plate 2, which is disposed in the center. The strong diffusion plate 3 has an annular surface of inverted conical shape which is low at the inner peripheral edge and high at the outer peripheral edge. A strong diffusion chamber 5 has an annular outer shape.

In FIGS. 5, 6 and 7, four partial annular incombustible component outlets 8 are provided, and four fourth diffusion plates 3" are disposed to extend radially, each lying between a pair of adjacent incombustible component outlets. Each fourth diffusion plate 3" has two downwardly inclined surfaces extending toward the incombustible component outlets 8 lying at both sides thereof. The downwardly inclined surfaces of the fourth diffusion plates 3" guide incombustible components of large specific gravity to the incombustible component outlets 8, thereby preventing deposition of incombustible components on the fourth diffusion plates 3". The other structures and functions of the arrangement shown in FIGS. 5, 6 and 7 are approximately the same as those of the embodiment shown in FIG. 2; therefore, a description thereof is omitted.

Figure 8:
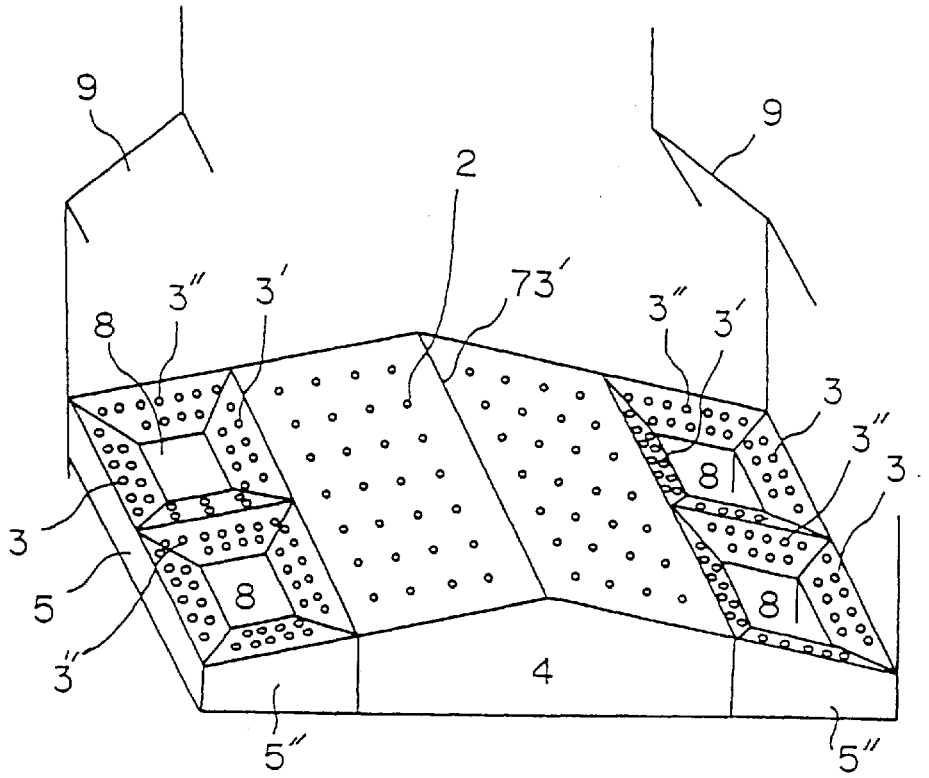
FIG. 8 is a perspective view schematically showing a furnace bottom portion of a fluidized-bed thermal reaction apparatus according to a sixth embodiment of the present invention.

FIG. 8 is a perspective view schematically showing a furnace bottom portion of a fluidized-bed thermal reaction apparatus according to a sixth embodiment of the present invention, which is equivalent to a case where in the embodiment shown in FIG. 2 the planar configuration of the furnace is rectangular. In FIG. 8, a weak diffusion plate 2 has a roof-shaped configuration which is rectangular as viewed in plan and which has a ridge 73' at the center. The weak diffusion plate 2, auxiliary diffusion plates 3', incombustible component outlets 8, and strong diffusion plates 3 are disposed in symmetry with respect to the ridge 73', and all of them are rectangular. The apparatus shown in FIG. 8 includes fourth diffusion plates 3" which extend perpendicularly to the ridge 73' and parallel to the edges of the incombustible component outlets 8. The fourth diffusion plates 3" have downwardly inclined surfaces extending toward the associated incombustible component outlets 8. The downwardly inclined surfaces of the fourth diffusion plates 3" guide incombustible components of large specific gravity to the incombustible component outlets 8, thereby preventing deposition of incombustible components on the fourth diffusion plates 3". The other structures and functions of this embodiment are approximately the same as those of the embodiment shown in FIG. 2; therefore, a description thereof is omitted.

Figure 9:
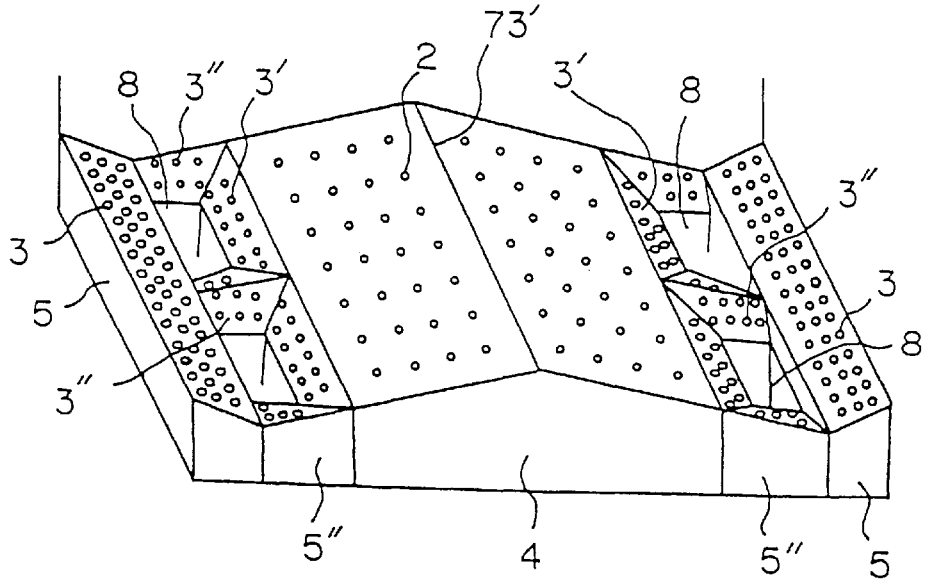
FIG. 9 is a perspective view schematically showing a furnace bottom portion of a fluidized-bed thermal reaction apparatus according to a seventh embodiment of the present invention.

FIG. 9 is a perspective view schematically showing a furnace bottom portion of a fluidized-bed thermal reaction apparatus according to a seventh embodiment of the present invention, which is equivalent to a case where in the embodiment shown in FIG. 2 the planar configuration of the furnace is rectangular. This embodiment has approximately the same arrangement as that in FIG. 8 but differs from the arrangement shown in FIG. 8 in that the edge of each strong diffusion plate 3 which is adjacent to the neighboring incombustible component outlets 8 is in a plane of extension of the inclined surface of the weak diffusion plate 2, while the edge of each strong diffusion plate 3 which is adjacent to the side wall is above the plane of extension of the inclined surface of the weak diffusion plate 2. The other structures and functions of this embodiment are approximately the same as those of the embodiment shown in FIGS. 2 or 8; therefore, a description thereof is omitted. The apparatuses shown in FIGS. 8 and 9 have a relatively small number of curved portions and are therefore relatively easy to design and produce. Accordingly, the production cost is relatively low.

FIG. 10 is a graph showing the relationship between the total heat transfer coefficient of a heat recovery device and the speed of fluidization by a fluidizing gas supplied through a third diffusion plate 28 in the fluidized-bed thermal reaction apparatus according to the present invention. When the fluidizing speed is in the range of from 0 to 0.3 m/s, particularly from 0.05 to 0.25 m/s, the total heat transfer coefficient of the heat recovery device changes markedly according to the fluidizing speed. Accordingly, if the total heat transfer coefficient is changed by controlling the fluidizing speed in the heat recovery chamber in such a fluidizing speed range, the amount of heat recovered can be controlled over a wide range.

FIG. 11 is a sectional view schematically showing a fluidized-bed thermal reaction apparatus according to an eighth embodiment of the present invention, which has a structure in which a melt combustion furnace 90 is connected to a fluidized-bed thermal reaction apparatus. The fluidized-bed thermal reaction apparatus has the same structure as that shown in FIG. 2 but is operated as a gasification furnace. A product produced in a fluidized-bed furnace 1, which contains a combustible gas, lightweight and fine unburnt components such as char and tar, fly ash, etc., is sent to a vertical circular cylinder-shaped primary combustion chamber 82 of the melt combustion furnace 90 where the product is burned and ash-melted as a post-treatment at a high temperature in the vicinity of 1,350° C., for example, with secondary air or oxygen 83 added thereto, and further burned and ash-melted in an inclined secondary combustion chamber 84. The resulting exhaust gas 93 and molten slag 95 are separated in an exhaust chamber 92 and discharged separately from each other. The secondary combustion chamber 84 is provided according to need.

ADVANTAGEOUS EFFECTS OF THE INVENTION

Principal effects and advantages of the present invention are as follows:

(1) In the fluidized-bed thermal reaction apparatus, a main circulating stream including a downward stream and upward stream of fluid medium is formed, and combustible matter is dropped into the upper part of the downward stream, mixed into the main circulating stream and burned. Accordingly, it is possible to burn or gasify uniformly and efficiently combustible matter such as waste matter, which varies in size, incombustible component content, specific gravity, etc.

(2) Combustible matter moves in the downward and horizontal streams while being burned, decomposed and gasified, and incombustible components of large specific gravity are guided to the incombustible component outlet along the downwardly inclined surface of the weak diffusion plate while being gradually separated from combustible components of small specific gravity by the pneumatic elutriation and gravity separation. At the incombustible component outlet, the incombustible components settle and are separated by gravity separation and smoothly taken out of the furnace. Therefore, no incombustible components will deposit on the furnace bottom, and incombustible components will cause minimal trouble in the supply of fluidizing gas, combustion or gasification, heat recovery, etc. Moreover, removed incombustible components can be readily treated because the combustible matter content is low.

(3) A part of fluidizing gas is supplied from the incombustible component outlet, or the incombustible component outlet is provided to open horizontally, not upwardly. Accordingly, the fluidizing gas is supplied from the entire furnace bottom surface, and thus a stable main circulating stream of fluid medium is formed. Therefore, it is possible to burn or gasify combustible matter uniformly and efficiently and to operate the apparatus smoothly. It is possible to realize complete combustion or high-efficient gasification of combustible matter by controlling the combustion air quantity.

(4) A heat recovery chamber is formed between the inclined wall and the furnace side wall, and a third diffusion plate is disposed underneath the heat recovery chamber. The third diffusion plate has approximately the same slope as that of the strong diffusion plate and further has a downwardly inclined surface extending toward the incombustible component outlet. Therefore, incombustible components in the heat recovery chamber are smoothly guided to the incombustible component outlet without preventing heat recovery. In addition, the heat transfer coefficient of the heat recovery device can be changed to a considerable extent by controlling the fluidizing gas supplied through the third diffusion plate. Therefore, it is easy to control the amount of heat recovered.

We claim:

1. A fluidized-bed thermal reaction apparatus in which combustible matter containing incombustible components can be burned or gasified in a fluidized-bed furnace, said apparatus comprising:

a weak diffusion plate and a strong diffusion plate, each having a large number of fluidizing gas feed holes disposed in a bottom portion of the furnace;

an incombustible component outlet disposed between said weak diffusion plate and said strong diffusion plate;

a combustible matter feed opening disposed such that combustible matter can be dropped into a region over said weak diffusion plate;

said weak diffusion plate being capable of supplying a fluidizing gas so as to give a relatively low fluidizing speed to a fluid medium and form a downward stream of fluid medium, said weak diffusion plate having a downwardly inclined surface extending toward said incombustible component outlet;

said strong diffusion plate being capable of supplying a fluidizing gas so as to give a relatively high fluidizing speed to the fluid medium and form an upward stream of fluid medium;

a part of the fluidizing gas being supplied into the furnace through said incombustible component outlet;

an auxiliary diffusion plate having a large number of fluidizing gas feed holes disposed between said weak diffusion plate and said incombustible component outlet, said auxiliary diffusion plate being capable of supplying a fluidizing gas so as to give a relatively high fluidizing speed to the fluid medium, said auxiliary diffusion plate having a downwardly inclined surface with a steeper slope than that of said weak diffusion plate between a lower edge of said weak diffusion plate and said incombustible component outlet such that said downwardly inclined surface extends toward said incombustible component outlet; and an inclined wall disposed over said strong diffusion plate to turn over the fluidizing gas and fluid medium flowing upwardly above said strong diffusion plate toward a central portion of the furnace, said strong diffusion plate having an upwardly inclined surface which gradually rises as a distance from said incombustible component outlet increases, and said strong diffusion plate being arranged such that a fluidizing speed gradually increases as a distance from said incombustible component outlet increases.

2. A fluidized-bed thermal reaction apparatus according to claim 1, further comprising a heat recovery chamber formed between said inclined wall and a furnace side wall, said heat recovery chamber communicating with the furnace central portion at upper and lower ends of said inclined wall, a heat recovery device disposed in said heat recovery chamber, and a third diffusion plate disposed between said strong diffusion plate and the furnace side wall such that said third diffusion plate is contiguous with an outer edge of said strong diffusion plate, said third diffusion plate being capable of supplying a fluidizing gas so as to give a relatively low fluidizing speed to the fluid medium in said heat recovery chamber, said third diffusion plate having an upward inclined surface with the same slope as that of said strong diffusion plate.

3. A fluidized-bed thermal reaction apparatus according to claim 1, wherein a bottom of said fluidized-bed furnace and said weak diffusion plate each are approximately circular as viewed in plan, said weak diffusion plate has a conical shape in which a center of a circular portion is high and a peripheral edge of said circular portion is low, said incombustible component outlet has a configuration comprising a plurality of partial annular shapes disposed in concentric relation to said weak diffusion plate, and said strong diffusion plate is annular and disposed in concentric relation to said weak diffusion plate.

4. A fluidized-bed thermal reaction apparatus according to claim 1, wherein the fluidizing gas supplied into the furnace through said incombustible component outlet is supplied through an additional diffusion plate provided in said incombustible component outlet and having a large number of fluidizing gas feed holes to fluidize the fluid medium near and over an entrance of said incombustible component outlet.

5. A fluidized-bed thermal reaction apparatus according to claim 1, wherein the fluidizing gas is one or a combination of a plurality of gases selected from the group consisting of air, steam, oxygen, and combustion exhaust gas.

6. A fluidized-bed thermal reaction apparatus in which combustible matter containing incombustible components can be burned or gasified in a fluidized-bed furnace, said apparatus comprising:

a weak diffusion plate and a strong diffusion plate, each having a large number of fluidizing gas feed holes disposed in a bottom portion of the furnace;

an incombustible component outlet disposed between said weak diffusion plate and said strong diffusion plate;

a combustible matter feed opening disposed such that combustible matter can be dropped into a region over said weak diffusion plate;

said weak diffusion plate being capable of supplying a fluidizing gas so as to give a relatively low fluidizing speed to a fluid medium and form a downward stream of fluid medium said weak diffusion plate having a downwardly inclined surface extending toward said incombustible component outlet;

said strong diffusion plate being capable of supplying a fluidizing gas so as to give a relatively high fluidizing speed to the fluid medium and form an upward stream of fluid medium;

a part of the fluidizing gas being supplied into the furnace through said incombustible component outlet;

an inclined wall disposed over said strong diffusion plate to turn over the fluidizing gas and fluid medium flowing upwardly above said strong diffusion plate toward a central portion of the furnace;

a heat recovery chamber formed between said inclined wall and a furnace side wall, said heat recovery chamber being communicated with the furnace central portion at upper and lower ends of said inclined wall;

a heat recovery device disposed in said heat recovery chamber; and a third diffusion plate disposed between said strong diffusion plate and the furnace side wall such that said third diffusion plate is contiguous with an outer edge of said strong diffusion plate, said third diffusion plate being capable of supplying a fluidizing gas so as to give a relatively low fluidizing speed to the fluid medium in said heat recovery chamber, said third diffusion plate having an upwardly inclined surface with the same slope as that of said strong diffusion plate.

7. A fluidized-bed thermal reaction apparatus according to claim 6, wherein said strong diffusion plate has an upwardly inclined surface which gradually rises as a distance from said incombustible component outlet increases, and said strong diffusion plate is arranged such that a fluidizing speed gradually increases as a distance from said incombustible component outlet increases.

8. A fluidized-bed thermal reaction apparatus according to claim 6, wherein a bottom of said fluidized-bed furnace and said weak diffusion plate each are approximately circular as viewed in plan, said weak diffusion plate has a conical shape in which a center of a circular portion is high and a peripheral edge of said circular portion is low, said incombustible component outlet has a configuration comprising a plurality of partial annular shapes disposed in concentric relation to said weak diffusion plate, and said strong diffusion plate is annular and disposed in concentric relation to said weak diffusion plate.

9. A fluidized-bed thermal reaction apparatus according to claim 6, wherein the fluidizing gas supplied into the furnace through said incombustible component outlet is supplied through an additional diffusion plate provided in said incombustible component outlet and having a large number of fluidizing gas feed holes to fluidize the fluid medium near and over an entrance of said incombustible component outlet.

10. A fluidized-bed thermal reaction apparatus according to claim 6, wherein the fluidizing gas is one or a combination of a plurality of gases selected from the group consisting of air, steam, oxygen, and combustion exhaust gas.

11. A fluidized-bed thermal reaction apparatus in which combustible matter containing incombustible components can be burned or gasified in a fluidized-bed furnace, said apparatus comprising:

a weak diffusion plate and a strong diffusion plate, each having a large number of fluidizing gas feed holes disposed in a bottom portion of the furnace;

an incombustible component outlet disposed between said weak diffusion plate and said strong diffusion plate;

a combustible matter feed opening disposed such that combustible matter can be dropped into a region over said weak diffusion plate;

said weak diffusion plate being capable of supplying a fluidizing gas so as to give a relatively low fluidizing speed to a fluid medium and form a downward stream of fluid medium, said weak diffusion plate having a downwardly inclined surface extending toward said incombustible component outlet;

said strong diffusion plate being capable of supplying a fluidizing gas so as to give a relatively high fluidizing speed to the fluid medium and form an upward stream of fluid medium;

a part of the fluidizing gas being supplied into the furnace through said incombustible component outlet;

a bottom of said fluidized-bed furnace and weak diffusion plate each being approximately circular as viewed in plan;

said weak diffusion plate having a conical shape in which a center of a circular portion is high and a peripheral edge of said circular portion is low;

said incombustible component outlet having a configuration comprising a plurality of partial annular shapes disposed in concentric relation to said weak diffusion plate; and said strong diffusion plate being annular and disposed in concentric relation to said weak diffusion plate.

12. A fluidized-bed thermal reaction apparatus according to claim 11, further comprising an inclined wall disposed over said strong diffusion plate to turn over the fluidizing gas and fluid medium flowing upwardly above said strong diffusion plate toward a central portion of the furnace, said strong diffusion plate having an upwardly inclined surface which gradually rises as a distance from said incombustible component outlet increases, and said strong diffusion plate being arranged such that a fluidizing speed gradually increases as a distance from said incombustible component outlet increases.

13. A fluidized-bed thermal reaction apparatus according to claim 11, wherein the fluidizing gas supplied into the furnace through said incombustible component outlet is supplied through an additional diffusion plate provided in said incombustible component outlet and having a large number of fluidizing gas feed holes to fluidize the fluid medium near and over an entrance of said incombustible component outlet.

14. A fluidized-bed thermal reaction apparatus according to claim 11, wherein the fluidizing gas is one or a combination of a plurality of gases selected from the group consisting of air, steam, oxygen, and combustion exhaust gas.

15. A fluidized-bed thermal reaction apparatus in which combustible matter containing incombustible components can be burned or gasified in a fluidized-bed furnace, said apparatus comprising:

a weak diffusion plate, an auxiliary diffusion plate, and a strong diffusion plate, each having a large number of fluidizing gas feed holes, disposed in a bottom portion of the furnace;

an incombustible component outlet disposed between said auxiliary diffusion plate and said strong diffusion plate;

a combustible matter feed opening disposed such that combustible matter can be dropped into a region over said weak diffusion plate;

said weak diffusion plate being capable of supplying a fluidizing gas so as to give a relatively low fluidizing speed to a fluid medium and form a downward stream of fluid medium, said weak diffusion plate having a downwardly inclined surface extending toward said incombustible component outlet;

said auxiliary diffusion plate being capable of supplying a fluidizing gas so as to give a relatively high fluidizing speed to the fluid medium, said auxiliary diffusion plate having a downwardly inclined surface with a steeper slope than said weak diffusion plate between a lower edge of said weak diffusion plate and said incombustible component outlet such that said downwardly inclined surface of said auxiliary diffusion plate extends toward said incombustible component outlet;

said strong diffusion plate being capable of supplying a fluidizing gas so as to give a relatively high fluidizing speed to the fluid medium and form an upward stream of fluid medium;

a lower edge of said downwardly inclined surface of said auxiliary diffusion plate being substantially aligned with an edge of the adjacent said strong diffusion plate when viewed in plan, said two edges are being spaced from each other in a vertical direction; and said incombustible component outlet opening in a vertical gap between said two edges.

16. A fluidized-bed thermal reaction apparatus according to claim 15, further comprising an inclined wall disposed over said strong diffusion plate to turn over the fluidizing gas and fluid medium flowing upwardly above said strong diffusion plate toward a central portion of the furnace, said strong diffusion plate having an upwardly inclined surface which gradually rises as a distance from said incombustible component outlet increases, and said strong diffusion plate being arranged such that a fluidizing speed gradually increases as a distance from said incombustible component outlet increases.

17. A fluidized-bed thermal reaction apparatus according to claim 15, further comprising a heat recovery chamber formed between said inclined wall and a furnace side wall, said heat recovery chamber communicating with the furnace central portion at upper and lower ends of said inclined wall, a heat recovery device disposed in said heat recovery chamber, and a third diffusion plate disposed between said strong diffusion plate and the furnace side wall such that said third diffusion plate is contiguous with an outer edge of said strong diffusion plate, said third diffusion plate being capable of supplying a fluidizing gas so as to give a relatively lower fluidizing speed to the fluid medium in said heat recovery chamber, said third diffusion plate having an upwardly inclined surface with approximately the same slope as that of said strong diffusion plate.

18. A fluidized-bed thermal reaction apparatus according to claim 15, wherein a bottom of said fluidized-bed furnace and said weak diffusion plate each are approximately circular as viewed in plan, said weak diffusion plate has a conical shape in which a center of a circular portion is high and a peripheral edge of said circular portion is low, said incombustible component outlet has a configuration comprising a plurality of partial annular shapes disposed in concentric relation to said weak diffusion plate, and said strong diffusion plate is annular and disposed in concentric relation to said weak diffusion plate.

19. A fluidized-bed thermal reaction apparatus according to claim 15, wherein the fluidizing gas is one or a combination of a plurality of gases selected from the group consisting of air, steam, oxygen, and combustion exhaust gas.

20. A fluidized-bed thermal reaction apparatus in which combustible matter containing incombustible components can be burned or gasified in a fluidized-bed furnace, said apparatus comprising:

a weak diffusion plate and a strong diffusion plate, each having a large number of fluidizing gas feed holes disposed in a bottom portion of the furnace;

an incombustible component outlet disposed between said weak diffusion plate and said strong diffusion plate;

a combustible matter feed opening disposed such that combustible matter can be dropped into a region over said weak diffusion plate;

said weak diffusion plate being capable of supplying a fluidizing gas so as to give a relatively low fluidizing speed to a fluid medium and form a downward stream of fluid medium, said weak diffusion plate having a downwardly inclined surface extending toward said incombustible component outlet;

said strong diffusion plate being capable of supplying a fluidizing gas so as to give a relatively high fluidizing speed to the fluid medium and form an upward stream of fluid medium;

a part of the fluidizing gas being supplied into the furnace through said incombustible component outlet;

an auxiliary diffusion plate having a large number of fluidizing gas feed holes disposed between said weak diffusion plate and said incombustible component outlet, said auxiliary diffusion plate being capable of supplying a fluidizing gas so as to give a relatively high fluidizing speed to the fluid medium, said auxiliary diffusion plate having a downwardly inclined surface with a steeper slope than that of said weak diffusion plate between a lower edge of said weak diffusion plate and said incombustible component outlet such that said downwardly inclined surface extends toward said incombustible component outlet; and a bottom of said fluidized-bed furnace and said weak diffusion plate each being approximately circular as viewed in plan, said weak diffusion plate being a conical shape in which a center of a circular portion is high and a peripheral edge of said circular portion is low, said incombustible component outlet being a configuration comprising a plurality of partial annular shapes disposed in concentric relation to said weak diffusion plate, and said strong diffusion plate being annular and disposed in concentric relation to said weak diffusion plate.

21. A fluidized-bed thermal reaction apparatus according to claim 20, wherein the fluidizing gas supplied into the furnace through said incombustible component outlet is supplied through an additional diffusion plate provided in said incombustible component outlet and having a large number of fluidizing gas feed holes to fluidize the fluid medium near and over an entrance of said incombustible component outlet.

22. A fluidized-bed thermal reaction apparatus according to claim 20, wherein the fluidizing gas is one or a combination of a plurality of gases selected from the group consisting of air, steam, oxygen, and combustion exhaust gas.

* * * * *